US005461863A

United States Patent [19]

Simonds

[11] Patent Number: 5,461,863

[45] Date of Patent: Oct. 31, 1995

[54] TRANSDUCER FOR CONVERTING LINEAR ENERGY TO ROTATIONAL ENERGY

[75] Inventor: Edward L. Simonds, Adel, Iowa

[73] Assignee: Thermal Dynamics, Inc., Adel, Iowa

[21] Appl. No.: 322,695

[22] Filed: Oct. 13, 1994

[51] Int. Cl.[6] ..... F01K 13/00

[52] U.S. Cl. ..... 60/676; 60/507; 92/136

[58] Field of Search ..... 60/670, 676, 698, 60/716, 668, 507; 92/136, 140

[56] References Cited

U.S. PATENT DOCUMENTS

| | | |
|---|---|---|
| 47,315 | 4/1965 | McGill . |
| 257,462 | 5/1982 | Bookwalter . |
| 2,042,116 | 5/1926 | Morris . |
| 3,128,633 | 4/1964 | Bertin . |
| 4,259,841 | 4/1981 | Thomas . |
| 5,167,168 | 12/1992 | Beumer . |

*Primary Examiner*—Ira S. Lazarus
*Assistant Examiner*—Alfred Basichas
*Attorney, Agent, or Firm*—Zarley, McKee, Thomte, Voorhees, & Sease

[57] ABSTRACT

Multiple steam powered cylinders reciprocate to pivot arms back and forth connected to output drive shafts through one way clutches with the output drive shafts being interconnected through gears such that when one shaft is powered, the other is coasting. The inlet and outlet valves for each cylinder chamber are controlled by an actuator which instantaneously snaps the valves between open and closed positions. The power cylinders may be operated individually, in parallel or in series and as required, a valve passageway through the piston may be operated to equalize pressure. A pair of O-rings on the piston engage the cylinder wall only when the adjacent chamber is pressurized, thereby reducing drag in operation of the piston.

21 Claims, 4 Drawing Sheets

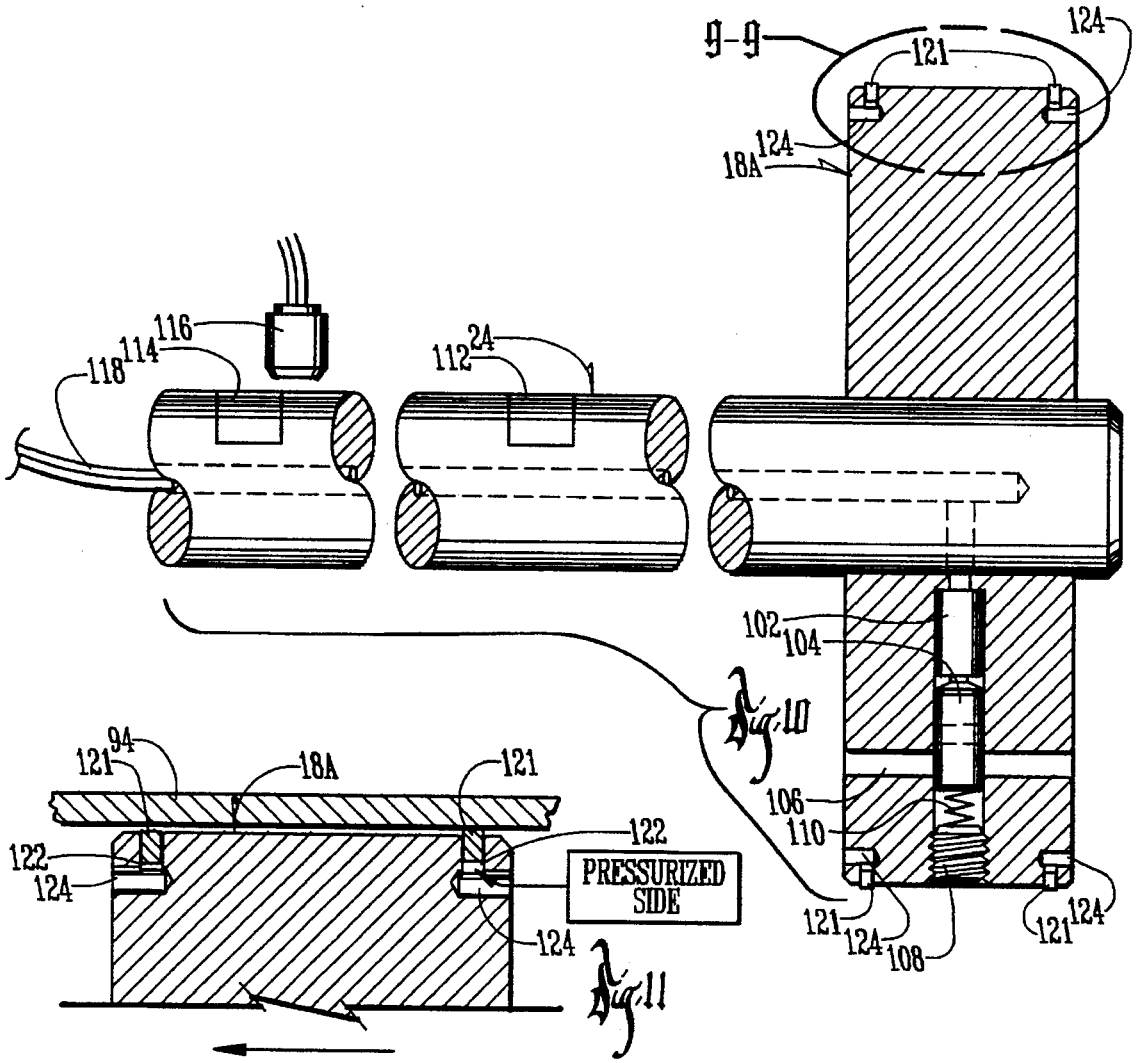
Fig. 10
Fig. 11
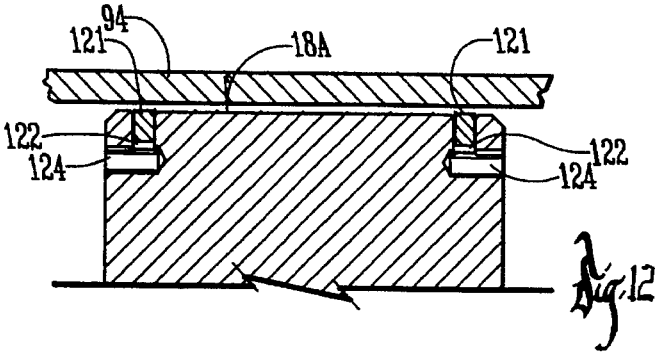
Fig. 12

TRANSDUCER FOR CONVERTING LINEAR ENERGY TO ROTATIONAL ENERGY

BACKGROUND OF THE INVENTION

The internal combustion engine, while improved over years of use, still falls short of being the ultimate power source for vehicles and other related uses. The engine is both inefficient and environmentally unfriendly due to its production of contaminants. It is believed that an alternative type power source has been found that has many advantages over the internal combustion engine

SUMMARY OF THE INVENTION

Any flowable medium may be used but steam is preferred for powering the transducer of this invention when converting linear energy into rotational power. A piston in a cylinder has chambers on opposite sides alternately receiving steam pressure through operation of a valve control system. A connecting rod connected to the piston reciprocates a pair of arms through approximately a 70 degree arc. Each of the arms are connected through one way clutches such as a Sprag clutch, to shafts carrying intermeshing gears whereby movement of the piston in one direction causes one gear to be powered while turning both gears and movement in the opposite direction causes the other gear to be powered while turning both gears. The one way clutches permit this alternate powering of one output shaft while the other is rotated as a slave. With this arrangement, there is no wasted motion on the part of the powered piston as it produces rotational power moving in both linear directions.

Multiple power cylinders may be connected to multiple pivot arms, in turn connected to common output drive shafts.

Through the operation of linkages operatively connected between the piston connecting rod and the control valves in inlet and outlet ports in each of the oppositely disposed cylinder chambers the transducer will be operated to produce continuous and instantaneous power as required. The linkages include spring means which accumulate pressure to overcome valve switching resistance which provides a snap type switching of pressure from one chamber to another.

Pressure in the chambers is monitored and if it is desired to equalize the pressure in both chambers, it can be done so through operation of a solenoid valve in a passageway in the piston connecting both chambers. Magnetic sensing is provided to determine the position of the piston and this information coupled with the pressure information are fed into a computer which allows for the desired control and operation.

A pair of O-rings are provided in annular slots in the outer piston wall for engagement with the cylinder wall. The slots communicate with the adjacent pressure chambers through a series of holes around the circumference of the piston end walls. Medium pressure in a chamber extends through the end wall holes and causes Teflon O-rings in the slots to expand outwardly into sealing engagement with the cylinder wall. The absence of pressure in a chamber allows the O-ring to contract into the annular slot reducing drag. Multiple power cylinders may be operated individually, in parallel or in series. When operating in series, the outlet port of the chamber of one cylinder is fed to the inlet port in the chamber of another cylinder in the sense of regenerative feedback.

It is possible, of course, to use an entirely different power source in combination with the one way clutch driven output rotational power shafts.

DESCRIPTION OF THE DRAWINGS

FIG. 10 is a cross sectional view taken along line 10—10 in FIG. 3 with an enlarged fragmentary side elevational view of the connecting rod and piston illustrating the valve in the passage way through the piston for selectively equalizing pressure in opposite chambers.

FIG. 11 is an enlarged cross sectional view of the O-ring taken along line 11—11 in FIG. 10 with the sealing elements on the periphery of the piston engaging the cylinder sidewall on the pressurized side of the piston and spaced therefrom on the non pressurized side.

FIG. 12 is view similar to FIG. 11 but showing the O-rings on the piston sidewall when pressure in both piston chambers is reduced and equalized.

DESCRIPTION OF THE PREFERRED EMBODIMENT

Figure 1:
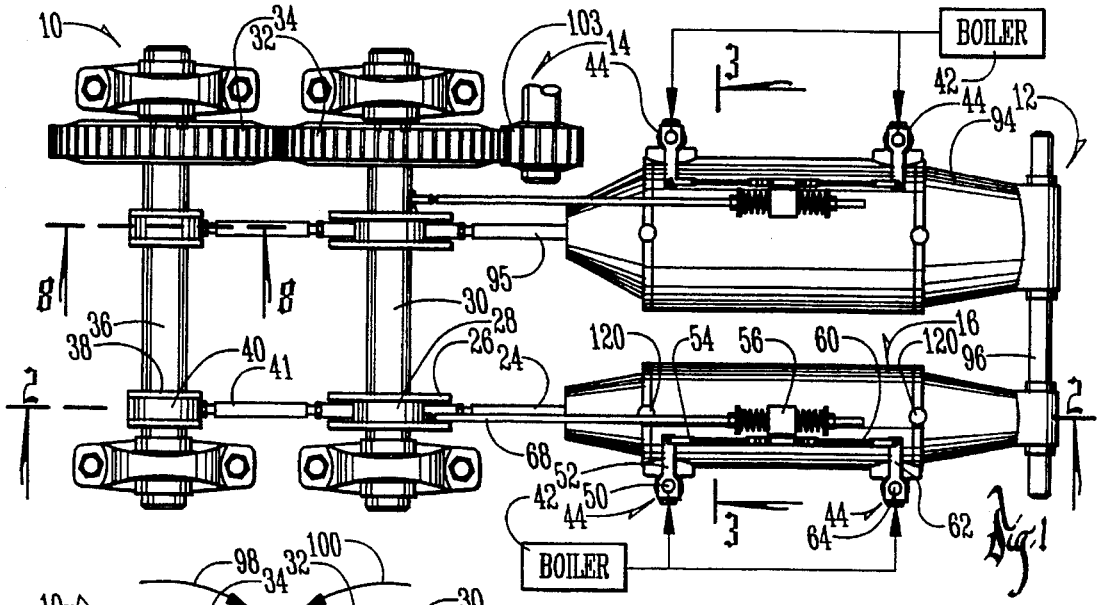
FIG. 1 is a top plan view of a transducer having two steam driven power cylinders connected through connecting rods to a pair of shafts which in turn are connected to output drive shafts through one way clutches.
Figure 2:
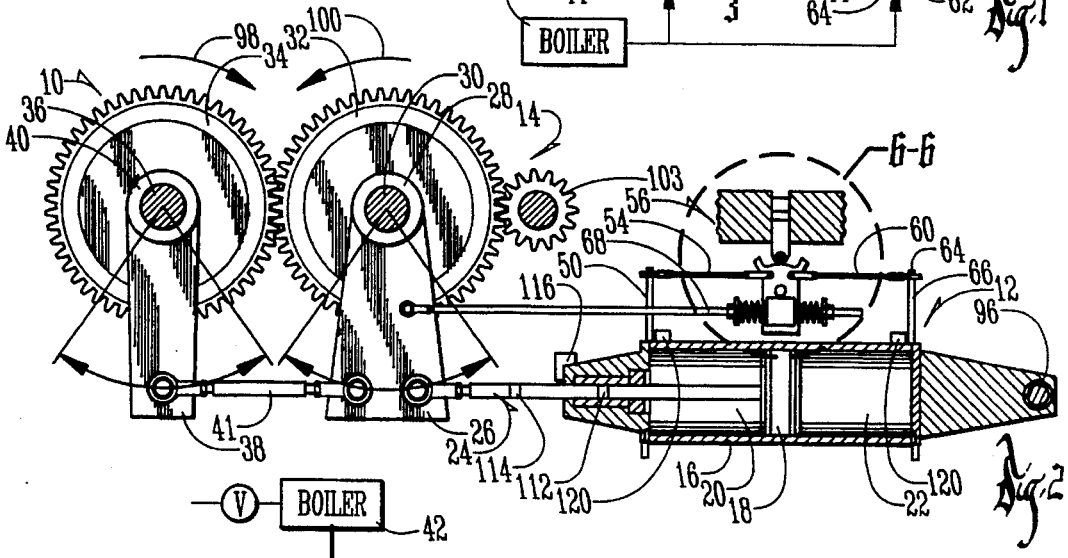
FIG. 2 is a side elevational view thereof taking along line 2—2 in FIG. 1.

The transducer of this invention is referred to in FIG. 1 generally by the reference numeral 10. It includes a linear power input section 12 which drives a rotational power output section 14.

The input section 12 of the invention 10 includes a power cylinder 16 having a piston 18 with oppositely disposed chambers 20 and 22. A connecting rod 24 extends from the cylinder 16 and is connected to a first crank arm 26 which is connected through a one way clutch 28 to an output shaft 30 having a gear 32 engaging a gear 34 on a second output drive shaft 36, also connected to a second crank arm 38 through a one-way clutch 40. The first crank arm 26 and second crank arm 38 are interconnected by a link 41.

Figure 3:
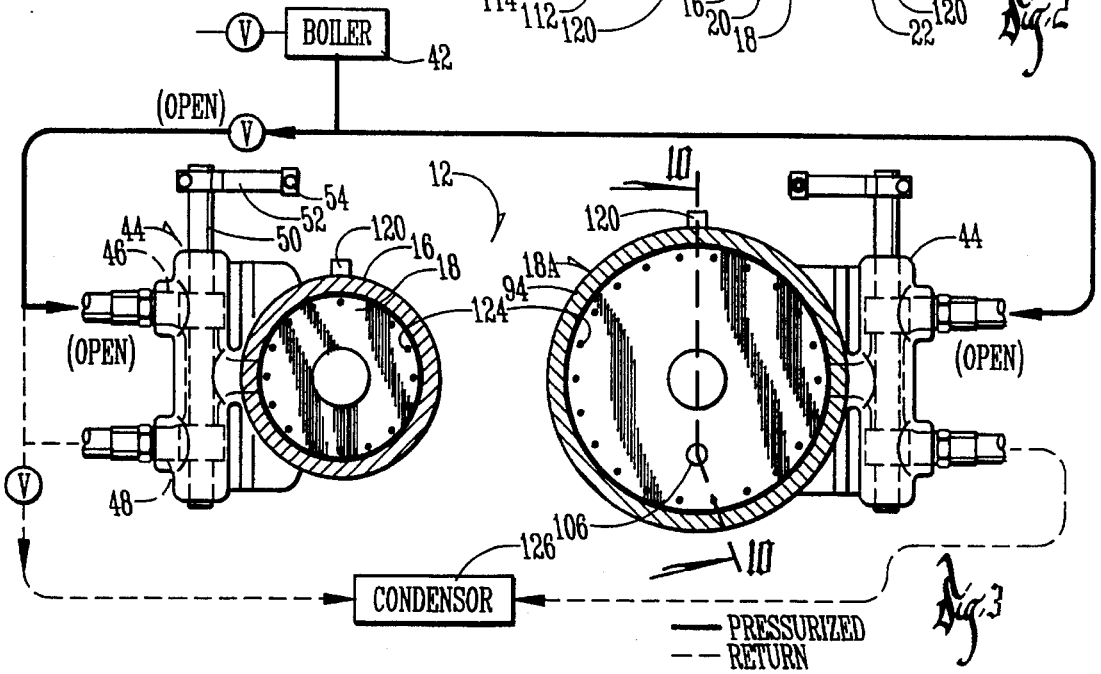
FIG. 3 is a cross sectional view taken along line 3—3 showing the steam line circuitry for powering the power cylinders arranged in parallel.
Figure 6:
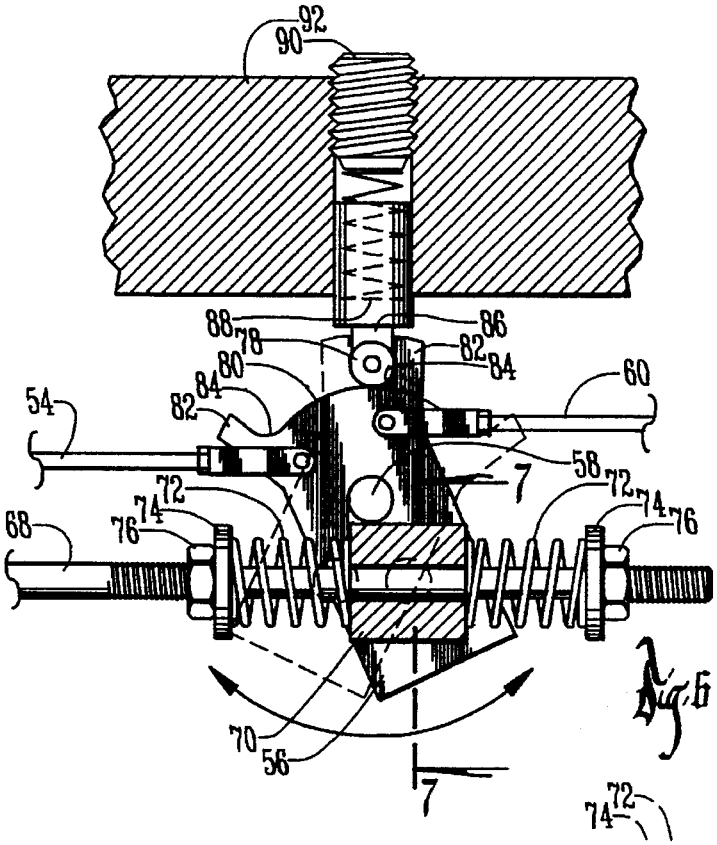
FIG. 6 is an enlarged fragmentary view as indicated along line 6—6 in FIG. 2, illustrating the control system including actuator for operating the inlet and outlet valves for each chamber of each cylinder.
Figure 7:
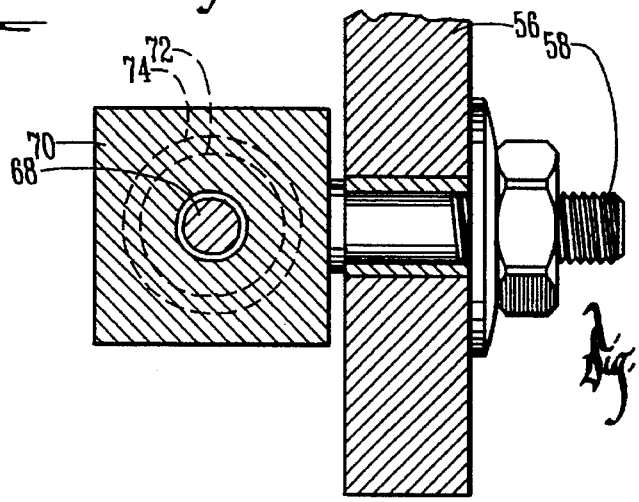
FIG. 7 is a cross sectional view taken along line 7—7 in FIG. 6.

Steam from a boiler 42 is provided to the chambers 20 and 22 alternately as seen in FIG. 3. A valve assembly 44 opens and closes in each chamber an inlet port 46 and an outlet port 48. The valve assembly 44 includes a shaft 50 connected to a horizontally extending arm 52 connected to a link 54, in turn connected to a pivotal actuator 56 which pivots about an axis 58 between the solid and dash line positions of FIG. 6. An oppositely disposed link 60 extends to the opposite end of the cylinder 16 where it is connected to an arm 62 pivotal about an axis 64 which is the longitudinal axis of an upstanding shaft 66 which operates a valve assembly like the valve assembly 44 in FIG. 3.

A link 68 extends through a block 70 pivotally connected to the actuator 56 and includes springs 72 mounted on opposite sides thereof held in place by washers 74 and nuts 76. The opposite end of the link 68 is connected to the first crank arm 26. A variable pressure resistance roller 78 rolls along a convex surface 80 on the top end of the actuator 56 between upstanding stop shoulders 82 having notches 84 to yieldably retain the roller 78 against each of the stops 82 as the actuator 56 pivots back and forth between the dash and solid line positions of FIG. 6. The resistance roller is carried on a shaft 86 pressed downwardly by a spring 88 adjustable tension is provided by an adjustment screw 90 mounted in a support member 92.

A second input power cylinder 94 larger in size than the cylinder 16, otherwise having the same components is connected through a connecting rod 95 to the output section 14 in the same fashion that the connecting rod 24 connects cylinder 16 to the output section. Like components are identified by like reference numerals. Both cylinders 16 and 94 are anchored to a common support shaft 96.

Figure 8:
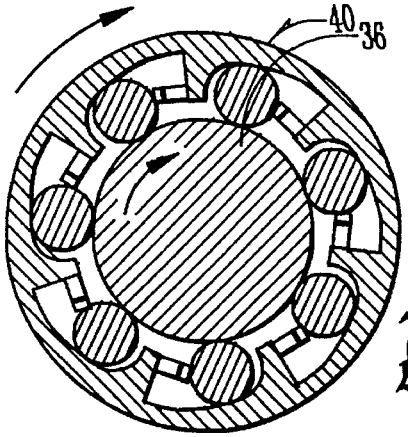
FIG. 8 is a cross sectional view taken along line 8—8 in FIG. 1 showing the one-way clutch in its driving condition.
Figure 9:
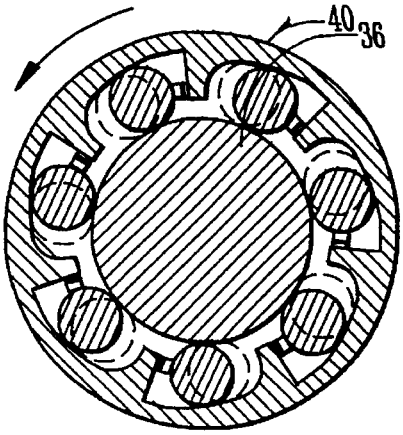
FIG. 9 is a cross sectional view similar to FIG. 8 but showing the one way clutch in free wheeling condition.

The operation of the transducer to this point involves steam from the boiler 42 being introduced into the chamber 22 of the cylinder 16 and presses on the right side of piston 18 to push the connecting rod 24 to the left in turn pivoting the first crank arm 26 to the left. The one way clutch 28 is connected to the output shaft 30, where movement of the crank arm 26 to the left does not cause any rotation of the shaft 30 since the one way clutch 28, as seen in FIG. 9, is disengaged from the shaft 30. The link 40, however, connected to the second crank arm 38, is pivoted to the left. Its one way clutch 40, as seen in FIG. 8, causes the shaft 36 to rotate in a clockwise direction as indicated by the arrow 98. The gear 34 on the shaft 36 engages the gear 32 on the shaft 30 and thus, causes it to rotate in the counter clockwise direction, as indicated by the arrow 100. This, in turn, causes an auxiliary output gear 103 to be rotated in a clockwise direction. When the piston 18 moves then to the right, the one-way clutch 40 will allow the second crank arm 38 to coast while the first crank arm 26 performs an output drive function by rotating the output shaft 30 in a counter clockwise direction and thus, it is seen that as the piston 18 moves in either direction, it is producing rotational output power.

It is desirable to have an instantaneous switching of the valves in the valve assembly 44 in a positive fashion such that pressure is applied exclusively to one chamber or the other of the chambers 20 and 22. This is accomplished by the use of the springs 72, which adsorb energy applied to them through the link 68. Once that pressure overcomes the resistance of the roller 78, engaging the convex surface 80 of the actuator 56, the actuator will be snapped to the opposite position, in turn, moving the links 54 and 60 which operate the valve assemblies 44 at opposite ends of the cylinder 16.

At times, it may be desirable to equalize the pressure on either side of the piston and this has been provided for as seen in FIG. 10, wherein the piston 18A in cylinder 94 includes a solenoid 102 which operates a valve 104 in a passageway 106 that communicates with the chambers on either side of the piston. A set screw 108 presses against a spring 110 which resists the action of the solenoid 102. Magnets 112 and 114 are mounted on the connecting rod 94 and their presence is sensed by the sensor 116 which sends a signal to a computer not shown which in turns sends a signal to the solenoid 102 through the wires 118. The computer will also receive information from a pressure sensor 120 as seen in FIG. 3 and this information combined with the piston position location information provided by the magnetic sensor 116 will determine if the solenoid valve 102 need be operated to neutralize pressure on either side of the piston 18A.

It is desirable to minimize the frictional drag between the piston 18A and the cylinder sidewall 94 as seen in FIGS. 11 and 12. A pair of neoprene O rings 121 are mounted in peripheral annular slots 122 which communicate with the adjacent chamber through a series of spaced apart openings 124. As seen in FIG. 11, pressure in a chamber on the right hand side will force the O-ring 121 outwardly into engagement with the interface of the cylinder wall 94. However, the left hand side not having any pressure allows the O-ring seal to remain spaced from the cylinder wall 94, thus, avoiding any unnecessary frictional drag. In FIG. 12, it is seen that both chambers on opposite sides of the piston 18A are under equal reduced pressure, thus, allowing the O-rings to remain spaced from the cylinder sidewall 94.

Figure 4:
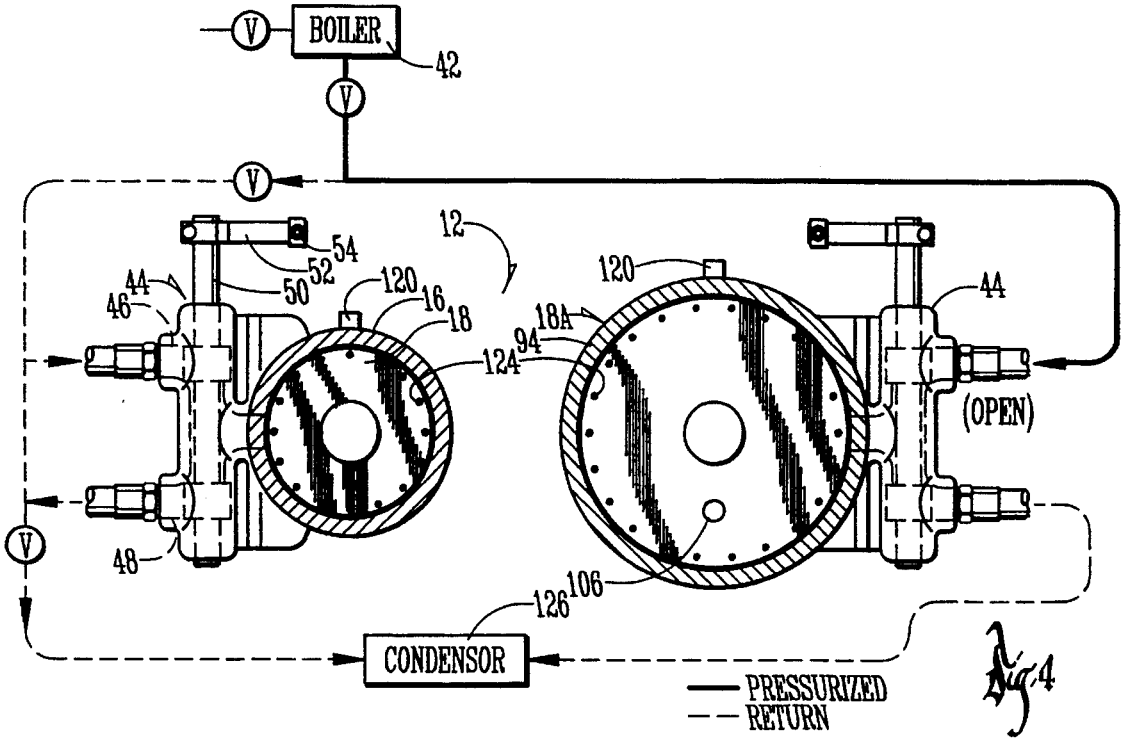
FIG. 4 is a view similar to FIG. 3, but showing the steam lines for operating only the larger of the two cylinders.
Figure 5:
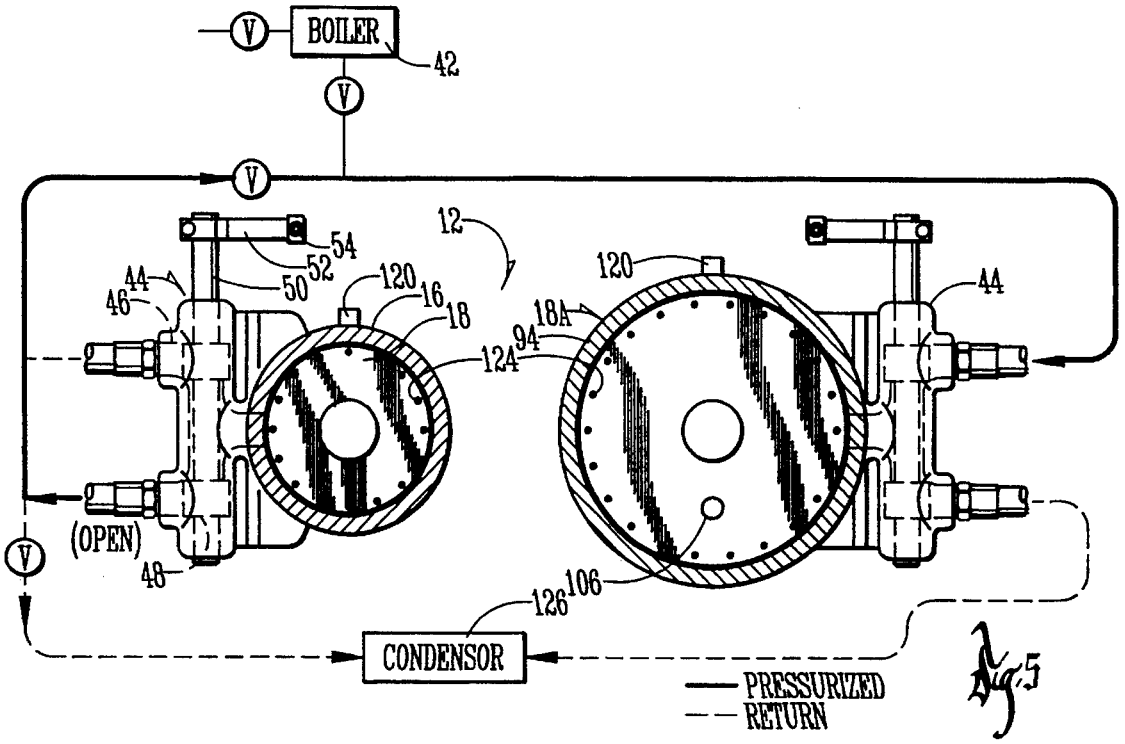
FIG. 5 is a view similar to FIG. 3, but showing the cylinders connected in series to provide feedback regenerative use of the flowable steam medium.

Three different modes of operation are shown in FIGS. 3, 4 and 5, with FIG. 3 showing both input power cylinders 16 and 18 being under power and functioning in parallel with each other to provide rotational output power to the shafts 30 and 36. In FIG. 4, the large cylinder 94 only is being operated and in FIG. 5, the outlet of the large cylinder 94 is fed to the inlet of the smaller cylinder 16 and then back to the condenser 126. This mode involves feedback and regeneration of the steam otherwise returned to the condenser as shown in FIGS. 3 and 4.

It is seen that there are numerous advantages in the use of a transducer of this invention as a rotational power source for vehicles or other equipment requiring rotational power. Consumption of energy through energy consuming friction has been minimized. The cranks 26 and 38 operate at maximum efficiency by pivoting only through 70 degrees of a possible 360 degree arc of rotation. The transducer of this invention can operate at a very low rpm and still produce the desired output power. The output shafts 30 and 36 provide constant power due to the instant on and off of control valves of valve assembly 44. The transducer is able to start in any position due to the valving system employed. The size of the transducer compared to a conventional engine can be reduced dramatically due to the absence of a crank shaft. The transducer, unlike the conventional internal combustion engine, produces no contaminates such as oil and fuel exhaust and involves no noise pollution and thus, is consequently more environmentally sound. The transducer will operate at a lower rpm and thus, eliminates centrifugal forces and the system's life is greatly extended. A very important distinction from the conventional engine is that when the transducer is not producing energy, it does not need to be idled as in the case of an automobile engine.

What is claimed is:

1. A transducer for converting linear energy to rotational energy comprising, a linear input power source connected to a connecting rod in turn connected to a first crank connected to a first output drive shaft having a first gear, a second crank operatively connected to said connecting rod and to a second output drive shaft having a second gear in engagement with said first gear on said first output drive shaft, one-way clutches interconnecting said first and second output drive shafts to said first and second cranks, and said power source reciprocating said connecting rod back and forth in opposite directions causing said first and second output drive shafts to be continuously rotated in a single direction, respectively.

2. A structure of claim 1 wherein said first and second output drive shafts are continuously rotated in opposite directions.

3. The structure of claim 2 wherein said first and second cranks are pivoted through less than 90 degrees during each cycle of operation.

4. The structure of claim 1 wherein said linear input power source includes a piston in a cylinder.

5. The structure of claim 4 wherein said cylinder includes pressure chambers on opposite sides of said piston.

6. The structure of claim 5 and said power source includes a flowable medium source and a control system for alternately directing medium to each of said pressure chambers to cause said connecting rod to be reciprocated.

7. The structure of claim 6 wherein said control system includes valve means for directing flowable medium to said first and second pressure chambers, and said piston is centered between said pressure chambers when said first and second cranks are centered in their range of movement during each cycle of operation.

8. The structure of claim 7 wherein said valve means is connected to an actuator means which is operateably connected to said piston, said opposite chambers being adapted to be alternately pressurized, said value means including inlet and outlet ports in each of said chambers, said one chamber is adapted to be pressurized when the inlet port in said one chamber is open while the input port in the other chamber is closed, and the outlet port in said one chamber is closed and the outlet port in said other chamber is open, said other chamber is adapted to be pressurized when the inlet port in said first chamber is closed and the inlet port in said other chamber is open, and the outlet port in said first chamber is open and the outlet port in said other chamber is closed.

9. The structure of claim 8 wherein said actuator means includes a link operatively connected to said connecting rod and a second link means connected to said valve means for opening and closing said valve means as said connecting rod moves back and forth in opposite directions.

10. The structure of claim 9 wherein actuator means includes a spring means interconnecting said first and second links such that energy is increased in said spring means as said first link moves in said opposite directions and is released when resistance to movement of said valve means is overcome thereby causing said valve means to be snapped between open and closed positions.

11. The structure of claim 10 wherein said actuator means includes a rocker block adapted to pivot about a pivot axis, and said first link means is connected to said rocker block on one side of said pivot axis and said second link is connected to said rocker block on the opposite side of said pivot axis such that said rocker block is pivotably snapped back and forth between opposite positions as said valve means are snapped between open and closed positions.

12. The structure of claim 7 wherein said flowable medium is steam.

13. The structure of claim 8 wherein said flowable medium is steam and a condenser is connected to said outlet parts in each of said chambers,

14. The structure of claim 8 and said flowable medium source is connected through said valve means to said inlet ports of said chambers.

15. The structure of claim 14 and multiple input power sources having a piston in a cylinder with pressure chambers on opposite sides equivalent to said first power source is provided, and said flowable medium source is connected through said valve means to inlet ports in said chambers where all power sources operate in unison to power said output drive shafts.

16. The structure of claim 4 wherein a second input power source is provided having a piston in a cylinder with pressure chambers on opposite sides, said second input power source being functionally equivalent to said first power source and having its inlet ports alternately connected to said outlet ports of said first power source whereby feedback flowable medium is utilized to supplement power for rotating the output drive shafts.

17. The structure of claim 16 wherein said second power source is smaller in its capacity to process said flowable medium.

18. The structure of claim 8 and said piston has passageway means through it for connecting said oppositely disposed chambers, a piston valve for opening and closing said passageway and to equalize pressure in each chamber.

19. The structure of claim 18 and a fixed sensor is provided adjacent to a signaling means on said connecting rod such that the position of said piston can be determined as it moves through each half cycle of operation.

20. The structure of claim 19 wherein said fixed sensor and signaling means includes interactive magnets which generate a signal transmitted to a computer operably connected to said piston valve for opening and closing said piston valve.

21. The structure of claim 8 wherein said piston includes peripherally positioned circumferential seal elements movably received in annular slots formed in the outer periphery adjacent opposite ends of said piston, and said piston having opposite end faces having openings connecting said annular slots to the adjacent chamber whereby pressure in said chamber yieldably forces said seal element outwardly into engagement with the cylinder and the absence of pressure in a chamber allows the adjacent seal to retract into its annular slot thereby reducing drag on said cylinder.

* * * * *